United States Patent [19]

Forte

[11] 4,155,502

[45] May 22, 1979

[54] CUP CARRIER

[75] Inventor: Robert L. Forte, Monroe, Mich.

[73] Assignee: Consolidated Packaging Corporation, Monroe, Mich.

[21] Appl. No.: 844,830

[22] Filed: Oct. 25, 1977

[51] Int. Cl.[2] ..... B65D 5/48; B65D 5/50

[52] U.S. Cl. ..... 229/28 BC; 229/52 BC; 224/45 AB; 206/194

[58] Field of Search ..... 229/28 BC; 206/602, 206/194; 224/45 AB, 45 BA

[56] References Cited

U.S. PATENT DOCUMENTS

| | | | |
|---|---|---|---|
| 1,486,967 | 3/1924 | Kaufman | 224/45 AB UX |
| 1,687,137 | 10/1928 | Myers | 224/45 AB UX |
| 1,910,168 | 5/1933 | Jacobs | 224/45 BA UX |
| 1,938,919 | 12/1933 | Marsh | 224/45 AB UX |
| 2,371,312 | 3/1945 | Potter | 229/28 BC X |
| 3,225,959 | 12/1965 | Jamison | 206/194 X |
| 3,386,643 | 6/1968 | Gentry | 206/602 X |
| 3,744,704 | 7/1973 | Struble | 229/28 BC |
| 3,780,906 | 12/1973 | Katzenmeyer | 229/28 BC X |
| 3,868,140 | 2/1975 | Gordon | 224/45 AB X |

*Primary Examiner*—Davis T. Moorhead
*Attorney, Agent, or Firm*—Hugh Adam Kirk

[57] ABSTRACT

A single folded fiberboard carrier for an even number of drinking vessels of varying shapes and sizes, having a central vertical suspending handle portion or section, and a pair of depending hinged apertured panels for clamping the conical or frusto-conical sides of drinking cups when suspended in the carrier, and for preventing tilting or spilling of the contents in the cups when the carrier is at rest and the cups are supported on their bottoms. The vertical handle portion is apertured for grasping with the fingers of one's hand and has depending therefrom tabs for engaging the rims of the smaller cups to prevent them from falling through their clamping apertures. Hinged divergently downwardly extending from each side of the handle portion are panels having elongated cup body engaging apertures, which may have inwardly extending tabs. At the outer edges of these diverging panels are hingedly supported downwardly and inwardly converging panels with elongated slightly smaller apertures vertically aligned with the apertures in the diverging panels. The bottom edges of the converging channels are hinged and joined together so that the carrier may be collapsed when not being used. One or more of the panels may be provided with an aperture for carrying straws for drinking the liquids in the carried cups.

6 Claims, 11 Drawing Figures

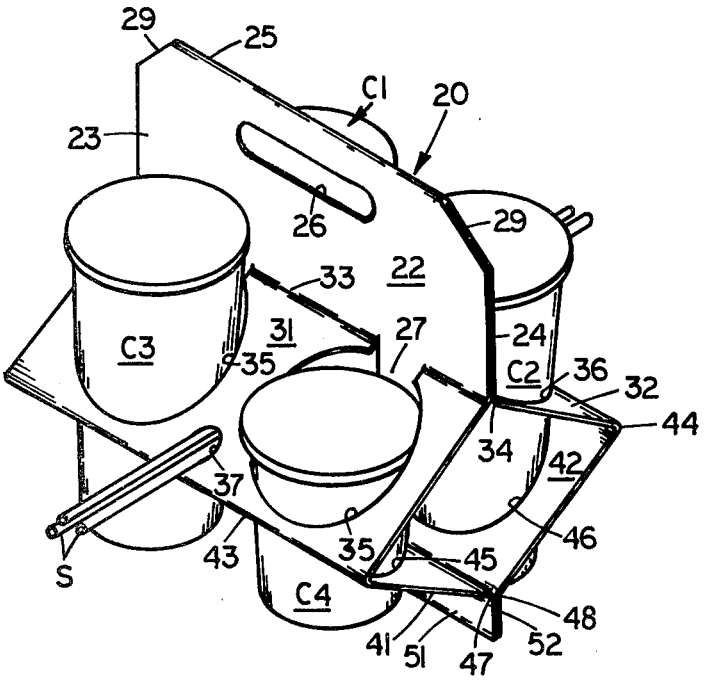
FIG. I
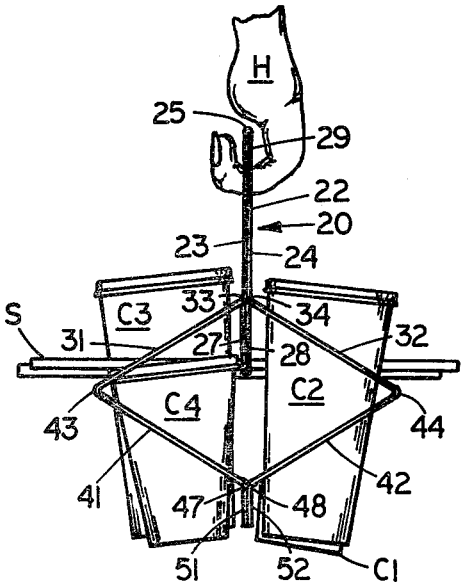
FIG. II
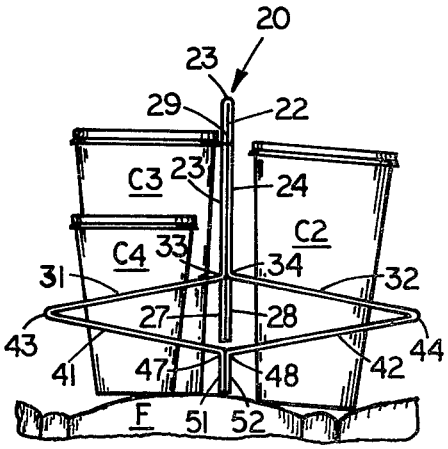
FIG. III

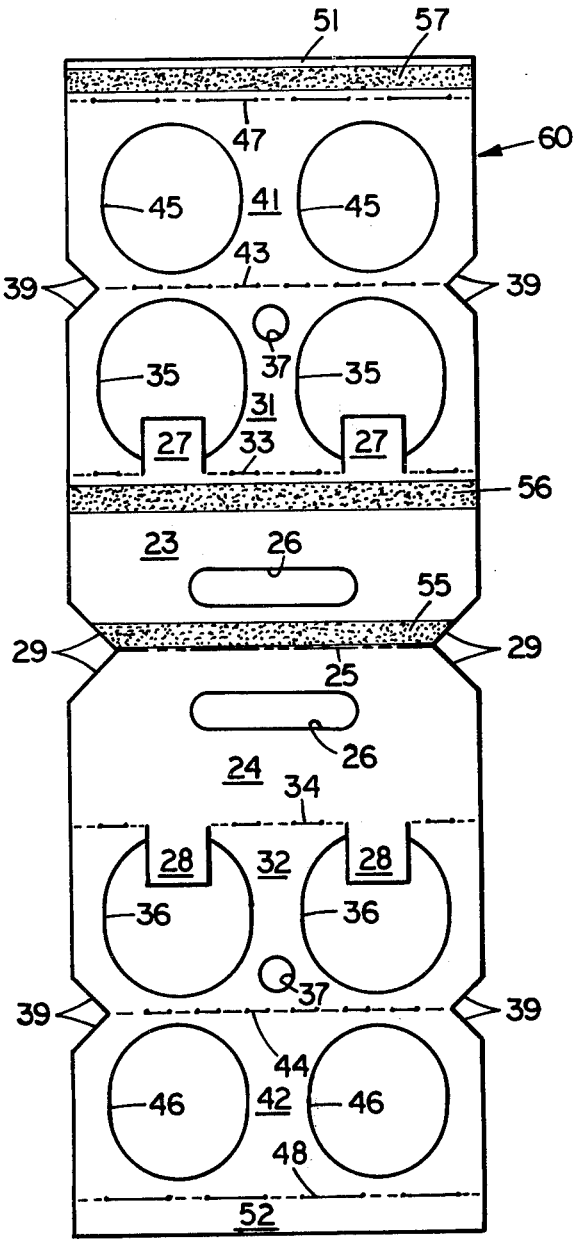
FIG. IV
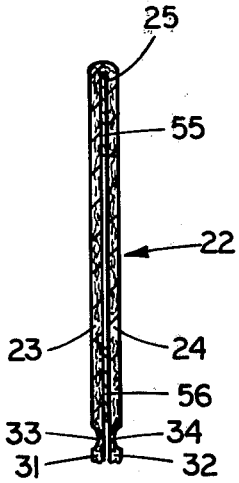
FIG. X
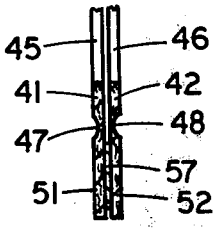
FIG. VIII
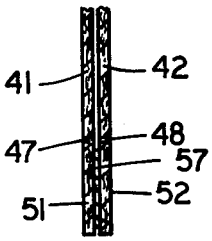
FIG. IX

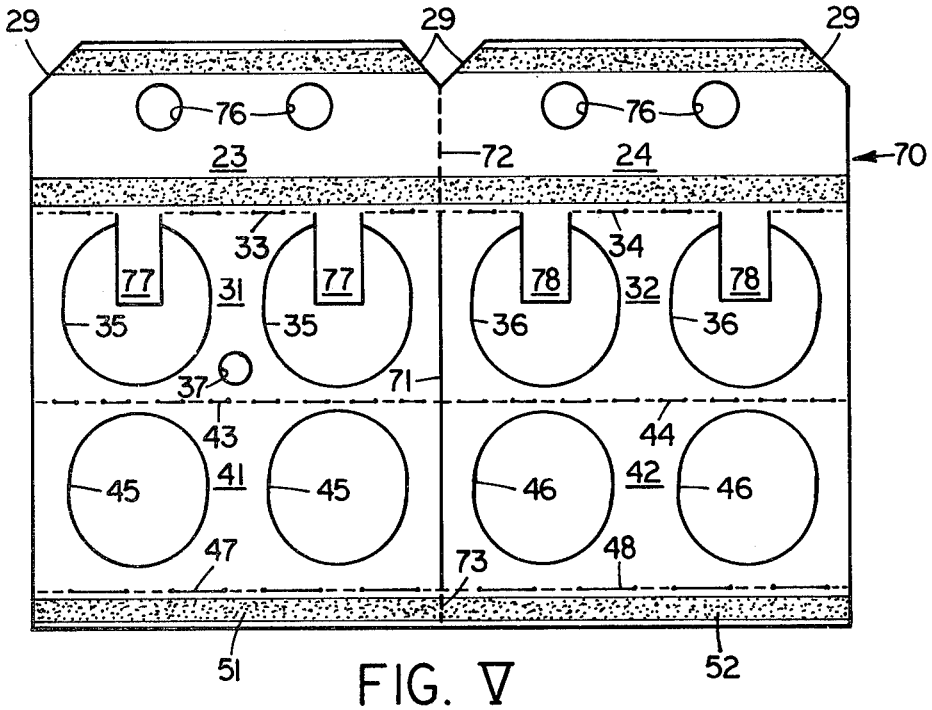
FIG. V
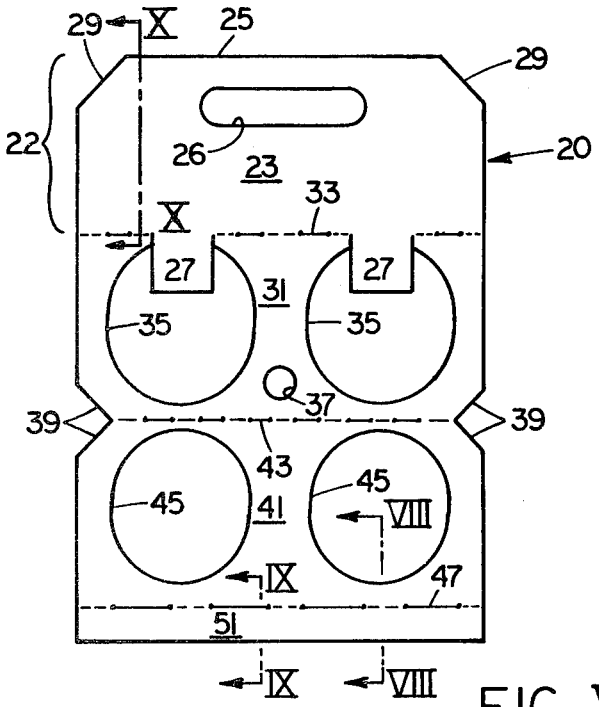
FIG. VII

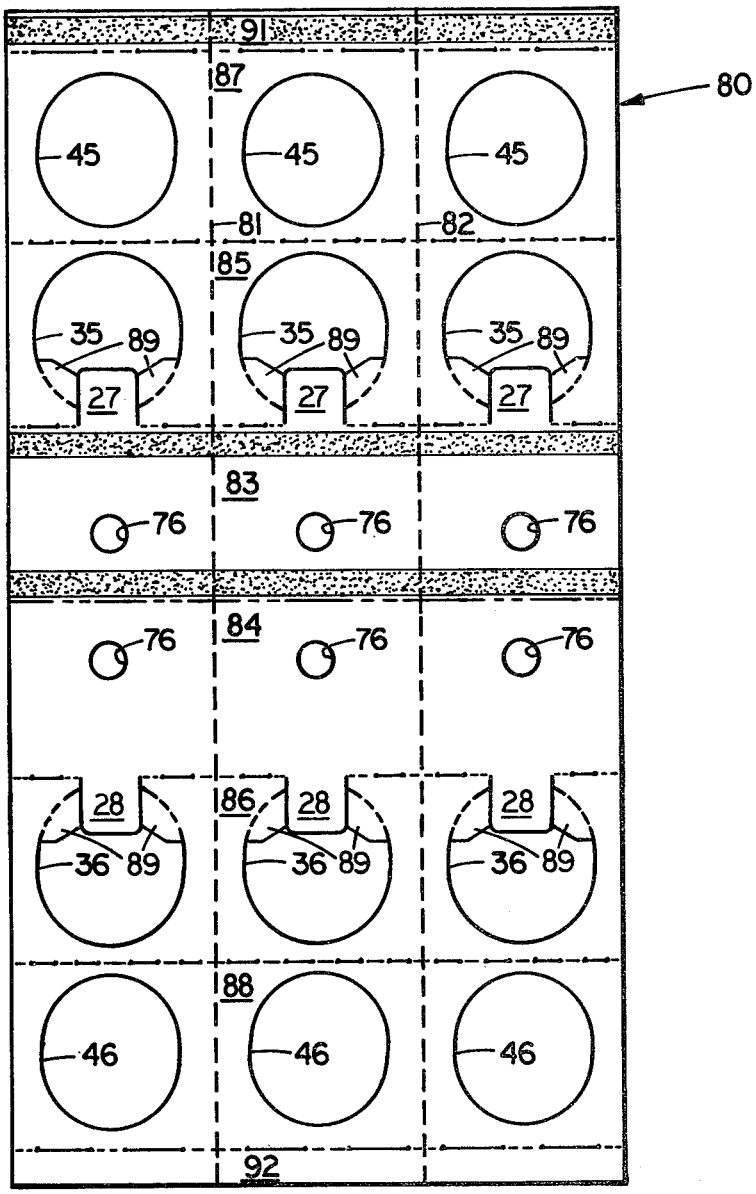
FIG. VI

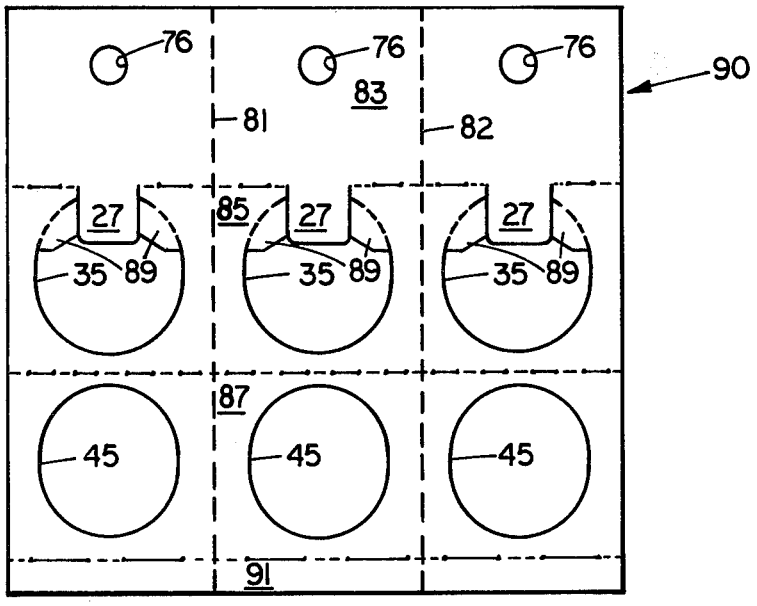
FIG. XI

CUP CARRIER

BACKGROUND OF THE INVENTION

Previously, packages or carriers for vessels such as of glass have been made with suspending handles, partitions or apertures for the vessels in horizontal or diverging apertured panels, and also including bottom panels for supporting the bases of the vessels to be packaged, supported or carried, such as shown in Struble U.S. Pat. No. 3,744,704 issued July 10, 1973, and Katzenmeyer U.S. Pat. No. 3,780,906 issued Dec. 25, 1973. Furthermore, such prior art supports or carriers were always made for vessels of a predetermined and uniform size and shape and were not adaptable for different size and shape containers unless the dimensions of their apertures were correspondingly changed, such as shown in Gordon U.S. Pat. No. 3,868,140 issued Feb. 25, 1975.

SUMMARY OF THE INVENTION

Generally speaking, the cup or drinking vessel carrier of this invention comprises a double thickness of an upwardly extending vertical fiberboard sheet handle portion or section having hingedly attached to its lower edges a pair of divergent outwardly and downwardly extending panels to the outer edges of which are hingedly attached downwardly and inwardly diverging panels hingedly connected together at their lower edges directly below the handle section. Each of these upper divergent and lower convergent panels have substantially vertically aligned elongated apertures, the upper panels generally having larger apertures than the lower panels to compensate for the normal frusto-conical shape of the drinking vessels carried therein. These apertures also are sufficiently large to receive and clamp vessels which vary in capacity at least about 100% and also have different heights as well as diameters and tapers to their frusto-conical outside surfaces. For example, this one carrier can carry any and/or all of the five or six different size cups or containers in which drinks of various types are sold from a fast food carry-out store, such as in paper or plastic cups varying from say one-half pint up to a pint-and-a-half or two pints in capacity.

Depending vertically from the bottom edges of the handle section, there are tabs which traverse, when the carrier is collapsed, at least about one-quarter of the diameter of the apertures in the upper panels, which tabs engage the upper rims of the smaller cups to prevent them from completely falling through the apertures in this panel. These tabs also limit the downward set-up movement of the carrier handle when their lower ends abut the joint between the converging lower panels to be sure that the diverging and converging panels are always spaced sufficiently to steady and support the drinking vessels or cups placed therein when these vessels or cups are resting their bottoms on a relatively horizontal surface. Thus the carrier also prevents the cups from being tipped over or their contents spilled when the carrier and its cups are not being carried, such as resting on the irregular surface of the seat of an automobile. Furthermore, if desired, one or more of the upper panels may be provided with an additional aperture into which drinking straws may be placed for the drinking of the contents from the cups supported in the carrier.

The single substantially rectangular blank from which the carrier of this invention may be produced may comprise a pair of complementary sections joined either end-to-end or side-to-side, each of which sections is provided with an upper handle panel portion, an intermediate upper apertured panel portion, and a lower apertured panel portion which also may include an end flap for attachment to a similar flap on the other section of panels complementary thereto. The apertures in the lower or outer panel portion are preferably smaller than those in the upper panel portion and each aperture is elongated transverse of the hinged joints between the panels.

The joints between the panel sections are cut and/or groove-scored to provide hinges which permit ready set-up of the carrier from their knockdown or flat collapsed position by pushing the handle portion toward the opposite end of the carrier to spread the diverging and converging panel portions and align their apertures vertically for the insertion of the drinking cups therein. The ends of the hinged joints between the upper and lower apertured panels, and the upper corners of the handles and/or of the bottom flaps may be rounded or beveled, if desired.

The handle panels of each half section of the blank are provided with one or more congruent apertures for one's fingers and are adhered together such as by glue strips above and below these apertures. Similarly the bottom flap portions are adhered together, leaving the intermediate aperture panels free to fold outwardly to form a rhomboid shape from their ends.

It is important in order to clamp the vessels of various different sizes that there is no bottom support for any of the vessels in the carrier, so that when the carrier is lifted by its handle, the angles of the upper and lower apertured panel sections will try to separate with the weight of the cups in their aperture to grab the sides of the cups and clamp them in the carrier, regardless of the level at which their different bottoms may finally take. If desired, a pair or more of circumferential inwardly extending tabs may be located in the upper larger elongated apertures to engage more firmly the smaller cups, which tabs are easily bent downwardly by the larger cups. However, once the carrier is placed on a relatively horizontal surface, the bottoms of the cups immediately conform with this surface while the upper and lower cup engaging apertures of the carrier still surround the cups to hold them together and prevent any one or more of the cups from being tipped over.

OBJECTS AND ADVANTAGES

One of the most important and unobvious features of this invention is the fact that such a simple carrier may be provided for supporting a variety of different shapes and sizes of cups or drinking vessels simultaneously without the necessity of providing a bottom support for any of these vessels.

Thus another object is to provide a simple, efficient, effective, economic carrier for a variety of different shapes and sizes of drinking vessels or cups.

Another object is to produce such a carrier from a single sheet of fiberboard which is easy to manufacture, uses a relatively small percentage of board and has a relatively small wastage of board or sheet material.

Still another object is to produce a beverage cup carrier for fast food stores which is stable, easy to set up, easy to carry, prevents tipping of the cups when the cups rest on a relatively horizontal surface, and grabs the cups when they are being transported to prevent them from sliding through the carrier, the grip being proportional to the weight of the material or fluid being supported in the cups. Thus, the more liquid or contents in the cups, the more stable the carrier.

BRIEF DESCRIPTION OF THE VIEWS

The above mentioned and other features, objects and advantages, and a manner of attaining them are described more specifically below by reference to embodiments of this invention shown in the accompanying drawings, wherein:

FIG. I is a perspective view of a preferred embodiment of the cup carrier of this invention supporting cups of different shapes and sizes;

FIG. II is an end view of the embodiment shown in FIG. I, showing how the different size cups take different vertical positions in the carrier when it is being suspended, and FIG. III is an end view similar to that of FIG. II showing the carrier and cups resting on an uneven horizontal surface;

FIG. IV is an embodiment of one of the shapes for a blank for forming the carrier shown in FIGS. I through III;

FIG. V is a view of another embodiment of a blank for forming the carrier shown in FIGS. I through III;

FIG. VI is a view of a blank of another embodiment of this invention which can be formed into a six-cup carrier that can be divided into two- and four-cup carriers;

FIG. VII is a view of a folded and glued blank or collapsed position of the carrier shown in FIGS. I through V;

FIGS. VIII and IX are enlarged cross-sections taken along lines VIII—VIII and IX—IX of FIG. VII showing a score and cut, respectively, of a hinge joint that may be employed for the fold lines in the blanks shown in FIGS. IV through VI;

FIG. X is an enlarged cross-section taken along line X—X of FIG. VII showing the fold at the top of the handle of the carrier when made from the blank shown in FIG. IV or V; and FIG. XI is a collapsed six-cup carton made from the blank shown in FIG. VI, which carrier may be divided before being set up into a two- and a four-cup carrier, or into three two-cup carriers.

DETAILED DESCRIPTION OF PREFERRED EMBODIMENTS

A. The Carrier

Referring to FIGS. I, II and III, there is shown one embodiment of a four-cup carrier 20 of this invention, carrying four different size and shape drinking vessels or cups C1, C2, C3 and C4.

This carrier 20 is formed from a single sheet of fiberboard or similar material and consists essentially of three sections, namely an upper vertically extending handle section 22, a pair of upper divergent outwardly and downwardly extending apertured panel sections 31 and 32 hinged to the bottom of the handle section 22; and a complementary pair of lower inwardly and downwardly apertured panel sections 41 and 42 hinged to the outer edges of the pair of upper sections 31 and 32 and hinged together along their convergent joined lower bottom edges. An important and unexpected feature of this invention is that it does not have a base, bottom, or tray section for the supporting of the bottoms of the cups C1 through C4 in the carrier. Once the collapsed carrier as shown in FIG. VII is set up in the form shown in FIGS. I, II and III so that the cups C1 through C4 can be placed in the apertures in the panel sections 31, 41 and 32, 42, the frusto-conical or substantially cylindrical sides of the cups C1 through C4 are clamped in the cooperating upper and lower panel apertures as shown in FIGS. 1 and II, with the different size cups seeking their respective different clamped positions when being transported by one's hand H engaging the handle section 20 as shown in FIG. II. Furthermore, when the assembly of cups C1 through C4 are resting on a substantially horizontal, but not necessarily level or even surface F as shown in FIG. III, the panel sections 31, 41 and 32, 42 continue to support the cups C1 through C4 so that they cannot easiy be tipped over and their contents spilled.

The handle section 22 herein comprises a double thickness of panels 23 and 24 which may be folded together along their top edge 25 and provided with congruent apertures 26 through which the fingers of the hand H of the lifter may easily pass for lifting the carrier 20 and its contents or cups C1 through C4. Depending from each panel 23 and 24 are tabs 27 and 28 that act as stops for spreading panel sections 31, 32 and 41, 42 too far as shown in FIG. III by engagement of their lower ends with the joint at the bottom of the two lower panel sections 41, 42 and also act, as shown in FIG. II, to engage the rims of the smaller cups, as vessel C4, to prevent these vessels from falling through the apertures in the upper panels 31, 32. If desired, the upper outer corners of the handle section 22 may be rounded or beveled as shown at 29 in FIG. I.

The upper apertured diverging panel sections 31 and 32 are preferably hinged along the lower edges of the handle section panels 23 and 24 by alternately cut and creased score fold lines 33 and 34, respectively, and are provided with centrally located apertures 35 and 36, which are from about 5% to about 10% longer extending away from the handle section 22 than they are wide, to permit the cups C1 through C4 free insertion into these apertures 35 and 36 when at an angle to the vertical axes of the cups as shown in FIG. III. One or both of these upper panels 31 and/or 32 also may be provided with a small aperture 37, if desired, for the insertion of straws S which may be used in the drinking of the contents of the cups C1 through C4.

Along the outer edges of the upper panel sections 31 and 32 there are hinged at 43 and 44 the outer edges of the lower panel sections 41 and 42, respectively, which panels 41 and 42 converge inwardly to fold lines 47 and 48 vertically under the vertical handle section 22 where these panels 41 and 42 are joined by a pair of flaps 51 and 52 which are attached together, such as by an adhesive. These lower converging panel sections 41 and 42 are provided with elongated apertures 45 and 46 through which the lower portion of the cups C1 through C4 fit as shown in FIGS. 1 through III. These apertures 45 and 46 are slightly smaller by about 5% to about 10% of the size of the apertures 35 and 36 in the complementary upper diverging panel sections 31 and 32, in order to conform better to the normal frusto-conical taper of the cups C1 through C4.

B. The Blanks

Referring now to FIGS. IV, V and VI, there are shown three different embodiments of shaped rectangular sheets or blanks from which a carrier of the type shown in FIGS. I through III may be formed.

First, referring to FIG. IV, there is shown one of the embodiments of a blank 60 which conforms to the configuration shown in FIGS. I through III, and comprises centrally the complementary rectangular handle panels 23 and 24 with their cooperating handle apertures 26, which panels 23 and 24 are hinged together along the center creased or scored fold line 25, which may be notched at its ends to form the beveled corners 29. These panels 23 and 24 also are provided with depending integral tabs 27 and 28 which may be cut rectangularly out of two divergent upper rectangular panel sections 31 and 32 diametrically from the elongated or oblong circular apertures 35 and 36. These panels 31 and 32 also may have cut therefrom circular holes 37 for the straws S.

The lower rectangular panel sections 41 and 42 are hinged by alternately cut and creased score lines 43 and 44 to the other and parallel edges of the upper panels 31 and 32, the ends of which lines 43 and 44 also may be notched to form the beveled corners 39. These panels 41 and 42 have elongated or oblong circular apertures 45 and 46, respectively, and along the parellel other edges there may be hinged the flaps 51 and 52 by alternately cut and creased score lines 47 and 48 by which the opposite ends of the blank 60 may be connected or fastened together, such as by an adhesive.

Thus, before this blank 60 is assembled into a knock-down or collapsed carrier 20 as shown in FIG. VII, glue strips 55, 56 and 57 may be placed lengthwise of one of the handle panels 23 on each side of the finger aperture 26 and on one of the flaps 51, respectively, as shown in FIG. IV. Then the blank 60 is folded along the score line 25 to form the collapsed carrier 20 as shown in FIG. VII and the glue strips 55 and 56 help strengthen the handle section 22.

Referring now to the blank 70 shown in FIG. V, the complementary sections of all the panels are shown adjacent each other with the adjacent ends of the panels 31, 32 and 41, 42 being cut-scored along the line 71, and the handle panels 23, 24 and flaps 51 and 52 are creases-cored or folded along the lines 72 and 73. In this embodiment the depending tabs 77 and 78 from the handle panels 23 and 24, respectively, are shown longer than those in the embodiment of FIGS. 1 through IV, and separate finger holes 76 are shown in the handle panels 23 and 24 aligned centrally above each of the elongated apertures 35, 45 and 36, 46 in the panel sections 31, 41 and 32, 42.

A further embodiment of a blank 80 is shown in FIG. VI for a six-cup carrier which may be divided into three two-cup carriers or one four-cup and one two-cup carrier.

This blank 80 has tear score lines 81 and 82 extending the full length of the blank 80 between each column of apertures in the larger rectangular panels 83, 84, 85, 86, 87, 88 and flaps 91, 92 corresponding respectively to panels 23, 24, 31, 32, 41, 42 and flaps 51, 52 in FIGS. I through VI, and each of these panels has three apertures 76, 35, 36, 45 and 46 respectively instead of one or two as previously described. Furthermore, this blank does not show the beveled corners 29 and 39, nor straw holes 37, but they may be included or eliminated in any of the blanks and its carrier without departing from the scope of this invention.

Also the depending tabs 27 and 28 from the handle panels 83 and 84 may have their outer corners rounded and they may be flanked by bendable tabs 89 attached y perforated and cut score lines to the edges of the apertures 35 and 36, which tabs may aid in gripping the sides of the smaller cups C4, but which tabs 89 are easily bent downwardly along their cut perforated and cut score lines by the larger cups C1, C2, or C3. It is to be understood that these tabs 89 may also be added to the other embodiments of this invention shown in FIGS. IV and V, if desired.

C. The Collapsed Carriers

Referring now to FIGS. VII through X, there is shown in FIG. VII an assembled and glued collapsed or knock-down carrier of the embodiment shown in FIGS. I through IV. FIGS. VIII and IX are enlarged cross-sections through the alternately creased and cut scored hinge lines 47 and 48, respectively. FIG. X shows the scored fold line 25 along the top of the handle section 22 joining the panel 23 and 24. The intermediate glued strips 55, 56 and 57 for holding the panels 23, 24 and 51, 52 together are also shown in FIGS. VIII, IX and X; however, any other means for fastening these panels together, such as staples, may be used without departing from the scope of this invention.

FIG. XI is an assembled and collapsed carrier 90 formed from the blank 80 shown in FIG. VI for six-cups, which carrier 90 may be divided into three two-cup carriers or a two- and a four-cup carrier by tearing it apart along the cut-score lines 81 and/or 82.

Thus the blanks for producing the carrier of this invention can be made out of rectangular single sheets of fiberboard or a similar flexible material and formed with substantially no loss of board, and then formed into a collapsed carrier by a simple glue and fold operation into an item which takes very little space for shipping and storage until used. Also this carrier is carefully designed to support simultaneously without a tray, a relatively wide variety of the same or different size and shape drinking vessels or cups. This makes this particular carrier advantageous for beverages from fast food carry-out stores.

While there is described above the principles of this invention in connection with specific articles, it is to be clearly understood that this description is made only by way of example and not as a limitation to the scope of this invention.

I claim:

1. A single substantially rectangular blank for a carrier for carrying simultaneously a plurality of frusto-conical cups of the same and/or different sizes and shapes, said blank comprising a plurality of substantially rectangular panels connected by fold lines which form hinges, said panels comprising:

A. a pair of complementary apertured handle panels having outwardly extending integral tabs, B. a first pair of panels hinged to said handle panels and having larger elongated apertures around said tabs, C. a second pair of panels hinged to said first pair of panels having smaller elongated apertures aligned with said larger elongated panel apertures, said elongated apertures of said second panels being elongated between about 5% and 10% greater in a direction outwardly from said handle portion, and D. hinge means at the outer extremity of at least one of said second pair of panels for attaching it to the outer extremity of the other second pair of second panels when said handle panels are attached together.

2. A blank according to claim 1 including tear-score lines between adjacent aligned first and second panel apertures for dividing said blank into at least two separate cup carriers.

3. A blank according to claim 1 including bendable tabs extending radially inwardly from the edges of said larger apertures.

4. A blank according to claim 1 wherein said larger apertures in said first panels are between about 5% and 10% larger in area than the smaller apertures in said second panels.

5. A carrier according to claim 1 wherein said tabs extend at least about one-quarter of the diameter of said apertures in said first panels.

6. A carrier according to claim 1 wherein at least one of said first panels includes an additional aperture for drinking straws for use in the cups carried by said carrier.

* * * * *